United States Patent [19]

Liston et al.

[11] 4,406,803

[45] Sep. 27, 1983

[54] METHOD FOR IMPROVING FUEL ECONOMY OF INTERNAL COMBUSTION ENGINES

[75] Inventors: Thomas V. Liston; Timothy R. Erdman, both of San Rafael, Calif.

[73] Assignee: Chevron Research Company, San Francisco, Calif.

[21] Appl. No.: 370,025

[22] Filed: Apr. 20, 1982

Related U.S. Application Data

[63] Continuation of Ser. No. 210,067, Nov. 24, 1980, abandoned.

[51] Int. Cl.[3] ..... C10M 1/20

[52] U.S. Cl. ..... 252/52 R; 252/32.7 E; 252/33.4; 252/42.7; 252/51.5 A

[58] Field of Search ..... 252/52 R

[56] References Cited

U.S. PATENT DOCUMENTS

| | | | |
|---|---|---|---|
| 2,800,516 | 7/1957 | Wilson | 252/52 R X |
| 3,180,832 | 4/1965 | Furey | 252/52 R X |
| 3,649,538 | 3/1972 | Hotten | 252/52 R X |
| 3,679,585 | 7/1972 | Brook et al. | 252/52 R X |
| 3,856,691 | 12/1974 | Haugen et al. | 252/52 R |
| 4,331,222 | 5/1982 | Liston et al. | 252/52 R X |

*Primary Examiner*—Andrew Metz

*Attorney, Agent, or Firm*—D. A. Newell; J. M. Whitney; V. J. Cavalieri

[57] ABSTRACT

Lubricating oils containing oil soluble $C_{10}$–$C_{30}$ alkane-1,2-diols have been found to reduce fuel consumption in an internal combustion engine.

6 Claims, No Drawings

METHOD FOR IMPROVING FUEL ECONOMY OF INTERNAL COMBUSTION ENGINES

This is a continuation of application Ser. No. 210,067 filed Nov. 24, 1980, now abandoned.

FIELD OF THE INVENTION

This invention relates to lubricating oil compositions and their use in reducing fuel consumption in internal combustion engines. More particularly, it deals with crankcase lubricating oil compositions containing long-chain 1,2-alkane diols.

BACKGROUND OF THE INVENTION

With the crisis associated with diminishing amounts of fossil fuel and the rapidly increasing prices for this fuel, there has been a great deal of interest in reducing the amount of fuel consumed by automobile engines, and the like.

Thus, there is a great need to find lubricants that reduce the overall friction in the engine, thus reducing the energy requirements thereto.

U.S. Pat. No. 4,201,684 teaches lubricating oils containing sulfurized fatty acid amides, esters or ester-amides of alkoxylated amines, which reduce friction between sliding metal surfaces in internal combustion engines.

U.S. Pat. No. 4,167,486 teaches lubricating oils containing certain acid esters having double bonds or the dimer or trimer of such acid esters. Reductions in fuel consumption in an internal combustion engine are claimed by using the lubricating oils in the crankcase of the engine.

So far as is known, no effort has been made to place lubricating oils containing the alkane-1,2-diols of this invention in the crankcase of an internal combustion engine.

U.S. Pat. No. 3,649,538 teaches a process for lubricating aluminum in an aluminum-shaping operation with a lubricant comprising a mineral oil and 0.1 to 30 volume percent of a $C_{10}$–$C_{30}$ 1,2-diol.

SUMMARY OF THE INVENTION

According to the present invention, lubricating oils are provided which reduce friction between sliding metal surfaces in the crankcase of internal combustion engines. The reduced friction results from the addition to the lubricating oil of small amounts of an alkane-1,2-diol of the formula:

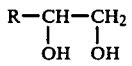

I wherein R is alkyl containing from 8 to 28 carbon atoms, or mixtures thereof.

Further, in accordance with the invention, there is provided a method for reducing fuel consumption in an internal combustion engine by treating the moving surfaces thereof with a composition comprising a major amount of a lubricant containing a fuel-reducing amount of the alkane-1,2-diols of the Formula I, or mixtures thereof.

DETAILED DESCRIPTION

The alkane-1,2-diols of the Formula I useful in the present invention are those having from 10 to 30, preferably 10 to 20, carbon atoms. Single carbon number species may be employed such as decane-1,2-diol, octadecane-1,2-diol, eicosane-1,2-diol, tricontane-1,2-diol, and the like, but a blend of several carbon numbers is preferred. Typical blends include the 1,2-diols of 10 to 30 (incl.) carbon atom alkanes; the 1,2-diols of 12, 14, 16, 18 and 20 carbon atom alkanes; the 1,2-diols of 15 to 20 (incl.) carbon atom alkanes; the 1,2-diols of 15 to 18 (incl.) carbon atom alkanes; the 1,2-diols of 20 to 24 (incl.) carbon atom alkanes; the 1,2-diols of 24, 26 and 28 carbon atom alkanes, and the like.

The diols useful for this invention are either commercially available or are readily prepared from the corresponding 1-olefin by methods well known in the art. For example, the olefin is first reacted with peracid, such as peroxyacetic acid or hydrogen peroxide plus formic acid to form an alkane-1,2-epoxide which is readily hydrolyzed under acid or base catalysis to the alkane-1,2-diol. In another process, the olefin is first halogenated to a 1,2-dihalo-alkane and subsequently hydrolyzed to an alkane-1,2-diol by reaction first with sodium acetate and then with sodium hydroxide.

1-Olefins are available from the thermal cracking of waxes. This process produces olefins of all carbon numbers. 1-Olefins having an even number of carbon atoms are prepared by the well-known ethylene "growth" reaction. Olefins obtained by either of these processes are essentially linear in structure with little or no branching. Linear olefins are the preferred olefins for conversion into alkane-1,2-diols.

The lubricating oils used in the process of this invention contain a major amount of a lubricating oil and from about 0.10 to 5.0 weight percent of alkane diol of Formula I, preferably, from 0.5 to 4.0 weight percent, and most preferably, 1 to 2 weight percent based on the weight of the total composition. The optimum amount of alkane diol within these ranges will vary slightly depending on the base oil and other additives present in the oil.

Additive concentrates are also included within the scope of this invention. In the concentrate additive form, the diol is present in a concentration ranging from 5 to 50 weight percent.

The lubricating compositions are prepared by admixing, using conventional techniques, the appropriate amount of the desired alkane-1,2-diol with the lubricating oil. When concentrates are being prepared, the amount of hydrocarbon oil is limited, but is sufficient to dissolve the required amount of alkane-1,2-diol. Generally, the concentrate will have sufficient diol to permit subsequent dilution with 1 to 10 fold more lubricating oil.

The alkane-1,2-diols of the Formula I can be used in mineral oil or in synthetic oils of viscosity suitable for use in the crankcase of an internal combustion engine. Crankcase lubricating oils have a viscosity up to about 85 SUS at 210° F.

The addition of the alkane-1,2-diols to the lubricating oil as described above results in improved mileage benefits in both compression and spark ignition engines.

Crankcase lubricating oils of the present invention usually have a viscosity up to about SAE 40. Sometimes such motor oils are given a classification at both 0° and 210° F., such as SAE 10W40 or SAE 5W30.

Mineral oil for use as the base oil in this invention includes paraffinic, naphthenic and other oils that are ordinarily used in the lubricating oil compositions.

The synthetic hydrocarbon oils include long-chain alkanes such as cetanes and olefin polymers such as trimers and tetramers of octene and decene. The synthetic oils with which these can be mixed include (1) ester oils such as pentaerythritol esters of monocarboxylic acids having 2 to 20 carbon atoms, (2) polyglycol ethers, (3) polyacetals, and (4) siloxane fluids. Especially useful among the synthetic esters are those made from polycarboxylic acids and monohydric alcohols. More preferred are the ester fluids made from pentaerythritol, or mixtures thereof with di- and tripentaerythritol, and an aliphatic monocarboxylic acid containing from 1 to 20 carbon atoms, or mixtures of such acids.

Blends of mineral oil with synthetic oil are also useful. For example, blends of 10–25 weight percent hydrogenated 1-decene trimer with 75–90 weight percent 150 SUS (100° F.) mineral oil gives an excellent lubricant base.

The lubricating oils are usually compounded with a variety of additives. These additives include antioxidants, dispersants, rust inhibitors, detergents, foam inhibitors, basic metal compounds, corrosion inhibitors, anti-wear agents, viscosity index (VI) improvers, friction control agents, elastomer swell agents, extreme pressure (EP) agents, pour point depressants, and metal deactivators. All of these additives are well known in the lubricating oil art.

Preferably, the conventional formulated oil will contain dispersants such as alkenyl succinimides, detergents such as alkali or alkaline earth metal hydrocarbyl sulfonates or phenates, or combinations thereof as well as the overbased metal derivatives thereof, and extreme wear and anti-wear agents such as alkyl, aryl, alkaryl or aralkyl zinc dithiophosphates.

More particularly, with respect to the alkali or alkaline earth metal hydrocarbyl sulfonate, the hydrocarbyl group may be derived from a petroleum fraction, from a synthetically alkylated aromatic fraction, or from an aliphatic group such as polyisobutylene. Examples of these are sodium, calcium, magnesium or barium salts of sulfonated petroleum fractions or of polyisobutylene which has been sulfonated. These compositions are well known in the art and include both neutral and overbased sulfonates having base numbers up to about 400 or more. In an ordinary formulation, they would be used in an amount to provide from 10 to 300 mmols/kg of alkaline earth metal and preferably, from 10 to 60 mmols/kg.

The phenate for use in this invention can be any one of those additives conventionally used in lubricating oil formulations which are alkali or alkaline earth metal salts of aromatic phenols ordinarily alkylated aromatic phenols wherein the alkylating group has from about 9 to about 30 carbon atoms. The phenol may be mono or dialkylated. Preferable salts are calcium, magnesium or barium salts. The phenates may be sulfurized and may also be neutral or overbased having base numbers up to 400 or more. These phenates are usually used in amounts to provide 10 to 300 mmols/kg alkali or alkaline earth metal and more preferably, about 10 to 60 mmols/kg.

The zinc dialkyl dithiophosphate contains from 3 to 18 carbon atoms in each alkyl group. These compositions are well known in the art. Preferred alkyl groups contain from 6 to 12 carbon atoms although mixed zinc dialkyl dithiophosphates may also be used wherein one group contains 3 to 4 carbon atoms and the other group contains 6 to 12 carbon atoms. The aryl, alkaryl or aralkyl zinc dithiophosphates contain from about 6 to 30 carbon atoms. Preferred groups include phenyl, benzyl, octylphenyl, and tetrapropenyl-substituted phenyl, and the like.

The succinimide present in the formulation is an alkenyl succinimide prepared by reacting, for example, a polyisobutenyl succinic anhydride with a polyethylene polyamine such as tetraethylene pentaamine. The alkenyl substituent is preferably a polyisobutene group having a molecular weight from about 800 to 5,000. Succinimides of this type are described in U.S. Pat. Nos. 3,172,892 and 3,219,666, the disclosures of which are hereby incorporated by reference. The alkenyl succinimide can be reacted with boric acid or a similar boron-containing compound to form borated dispersants having utility in this invention. The borated succinimides are intended to be included within the scope of the term "alkenyl succinimide".

As mentioned above, other additives conventionally used in the art may be used with the formulation disclosed in this invention. The formulations used commercially are often multigrade oils. Multigrade oils are obtained by adding viscosity index improvers as is well known in the art. Typical viscosity index improvers include polyalkyl methacrylates or ethylene-propylene copolymers or styrene diene copolymers. It is also possible to use a dispersant VI improver.

The following examples are offered to specifically illustrate the development. It is to be understood they are illustrations only and that the invention shall not be limited except as limited by the appended claims.

EXAMPLE 1

To a 3-liter reaction flask was charged 449 grams (2 mols) $C_{15-18}$ $\alpha$-olefins and 1,046 mls (20 mols) of 88% formic acid. To the stirred reaction mixture was added 453 mls of $H_2O_2$ (4 mols) through a dropping funnel over a period of 10 minutes. During the addition, the temperature in the flask rose from 23° to 29° C. The reaction mass was heated slowly to 95° C. over a period of 4 hours, where refluxing began. The reaction mixture was then cooled to ambient temperature (25° C.) and stirred for 96 hours. The formic acid was stripped off at 95° C. and about 120 mm Hg. The reaction mass was diluted with 500 mls of a mixture of toluene (75)/1-butanol (25%), neutralized with 1 liter of 20% NaOH in distilled water, stirred for 1 hour at reflux (92° C.) and transferred to a 4-liter separation funnel. The organic phase was separated, and washed with 500 mls of 0.6 N $NaHSO_3$. The organic phase was stripped on a roto vac for ½ hour at 120° C./0.3 mm Hg. The $C_{15-18}$ alkane-1,2-diol obtained was a waxy white solid and weighed 362.77 grams.

In a similar fashion, $C_{18-20}$ alkane-1,2-diol, 1,2-dodecanediol and 1,2-hexadecanediol are prepared by substituting the appropriate $\alpha$-olefin for the $C_{15-18}$ $\alpha$-olefins used in the above Example 1.

EXAMPLE 2

Tests were carried out which demonstrate the improvements in fuel economy obtained by adding oil compositions containing the alkane-1,2-diols of this invention to the crankcase of an automobile engine.

In these tests, Ford 302 CID 2.3 liter engines were run under constant output conditions with lubricating oils with and without the alkane-1,2-diols.

The engines were run on dynamometers at conditions simulating 55 miles per hour under approximately road load. This test was repeated several times under constant conditions with the base oil and then several times with the same oil containing 2 weight percent of the $C_{15-18}$ alkane-1,2-diol of Example 1. The base oil was a typical commercial oil formulated for use in a crankcase. The oil compositions of this invention containing the alkane-1,2-diol was found to reduce fuel consumption of the engine an average of 3–4%.

The comparisons were made with fully formulated 10W-30 oil containing 3–5% of an alkenyl succinimide, 30 mmols/kg overbased magnesium hydrocarbyl sulfonate, 20 mmols/kg of overbased sulfurized calcium phenate, 18 mmols/kg dialkyl zinc dithiophosphate, and 5.5% of a polymethacrylate-based VI improver.

Also, formulated crankcase oils each containing 2% by weight of $C_{18-20}$ alkane-1,2-diol, 1,2-dodecanediol or 1,2-hexadecanediol are also effective in reducing fuel consumption in an internal combustion engine.

What is claimed is:

1. In a lubricating oil formulated for use in the crankcase of an internal combustion engine, the improvement of including in said formulated oil about 0.10 to 5.0 weight percent of an alkane-1,2 -diol of the formula:

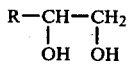

wherein R is alkyl containing from 8 to 28 carbon atoms, or mixtures thereof.

2. The composition of claim 1 wherein said alkane-1,2-diol contains from 10 to 20 carbon atoms.

3. The composition of claim 1 wherein said diol comprises a mixture of 1,2-diols containing from 15 to 18 carbon atoms.

4. A method for reducing fuel consumption in an internal combustuon engine by treating the moving surfaces thereof with a composition comprising a major amount of a lubricant containing a fuel-reducing amount of an alkane-1,2-diol of the formula:

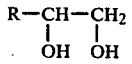

wherein R is alkyl containing from 8 to 28 carbon atoms, or mixtures thereof.

5. The method of claim 4 wherein said alkane-1,2-diol contains from 10 to 20 carbon atoms.

6. The method of claim 4 wherein said diol comprises a mixture of 1,2-diols containing from 15 to 18 carbon atoms.

* * * * *